US006463939B1

(12) United States Patent
Kornaat et al.

(10) Patent No.: US 6,463,939 B1
(45) Date of Patent: Oct. 15, 2002

(54) DISH WASHING PROCESS

(75) Inventors: Wilma Kornaat, Vlaardingen; Alastair Richard Sanderson, Bebington; Alan Digby Tomlinson, Vlaardingen, all of (NL)

(73) Assignee: Unilever Home & Personal Care, USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/498,564

(22) Filed: Feb. 4, 2000

(30) Foreign Application Priority Data

| | | |
|---|---|---|
| Feb. 5, 1999 | (EP) | 99300878 |
| Feb. 5, 1999 | (GB) | 9902626 |
| May 28, 1999 | (EP) | 99304177 |

(51) Int. Cl.[7] ..... B08B 9/20; C11D 3/00; C11D 3/02; C11D 3/16

(52) U.S. Cl. ..... 134/25.2; 134/41; 510/521; 510/522

(58) Field of Search ..... 134/25.2, 41; 510/521, 510/522

(56) References Cited

U.S. PATENT DOCUMENTS

| | | | | |
|---|---|---|---|---|
| 2,264,103 A | | 11/1941 | Tucker | |
| 3,036,013 A | | 5/1962 | Jaszka et al. | |
| 3,308,067 A | | 3/1967 | Diehl | |
| 3,941,713 A | | 3/1976 | Dawson et al. | |
| 3,983,254 A | | 9/1976 | Alterman et al. | |
| 4,126,573 A | | 11/1978 | Johnston | |
| 4,279,764 A | | 7/1981 | Brubaker | |
| 4,327,151 A | | 4/1982 | Mazzola | |
| 4,750,942 A | * | 6/1988 | Van Dijk et al. | 134/25.2 |
| 4,751,015 A | | 6/1988 | Humphreys et al. | |
| 5,041,232 A | | 8/1991 | Batal et al. | |
| 5,047,163 A | | 9/1991 | Batal et al. | |
| 5,066,415 A | | 11/1991 | Dany et al. | |
| 5,133,892 A | * | 7/1992 | Chun et al. | 252/90 |
| 5,382,377 A | * | 1/1995 | Raehse et al. | 252/174 |
| 5,597,789 A | | 1/1997 | Sadlowski | |
| 5,646,101 A | * | 7/1997 | Mac Beath | 510/220 |
| 5,668,100 A | * | 9/1997 | Schmid et al. | 510/446 |
| 5,691,300 A | * | 11/1997 | Fabry et al. | 510/514 |
| 5,712,244 A | * | 1/1998 | Addison et al. | 510/514 |
| 5,759,987 A | * | 6/1998 | Haerer et al. | 510/514 |
| 5,780,420 A | * | 7/1998 | Breuer et al. | 510/446 |
| 5,801,137 A | * | 9/1998 | Addison et al. | 510/228 |
| 5,807,529 A | * | 9/1998 | Kruse et al. | 423/332 |
| 5,866,531 A | * | 2/1999 | Assman et al. | 510/446 |
| 6,133,223 A | * | 10/2000 | Sampaio et al. | 510/444 |
| 6,228,833 B1 | * | 5/2001 | Pantz et al. | 510/444 |

FOREIGN PATENT DOCUMENTS

| | | |
|---|---|---|
| DE | 2 213 007 | 9/1973 |
| DE | 2 244 378 | 3/1974 |
| DE | 38 05 881 | 9/1989 |
| EP | 0 416 366 | 3/1991 |
| EP | 0 436 971 | 7/1991 |
| EP | 0 458 397 | 11/1991 |
| EP | 0 561 452 | 9/1993 |
| EP | 0 510 761 | 3/1995 |
| EP | 0 723 577 | 7/1996 |
| EP | 0 851 022 | 7/1998 |
| FR | 2176794 | 11/1973 |
| GB | 1 396 678 | 6/1975 |
| GB | 1425343 | 2/1976 |
| WO | 95/20030 | 7/1995 |
| WO | 98/30673 | 7/1998 |

OTHER PUBLICATIONS

European Search Report dated Jul. 6, 1999.
International Search Report dated Jan. 26, 2000.

* cited by examiner

*Primary Examiner*—Zeinab El-Arini
(74) *Attorney, Agent, or Firm*—Ronald A. Koatz

(57) ABSTRACT

A process for washing articles in a mechanical washing machine including the steps of:

(i) treating the articles with a wash liquor including a dishwashing composition; said composition when undiluted including greater than 20 wt.% of a bicarbonate salt followed by (ii) treating the articles with a rinsing solution including rinse aid the rinse aid when undiluted comprising at least 20 wt. % of a water soluble acid builder or salt thereof; wherein minimal rejuvenation of ion exchange material within the machine is needed.

9 Claims, No Drawings

DISH WASHING PROCESS

TECHNICAL FIELD

The present invention is in the field of machine dishwashing. More specifically, the invention encompasses automatic dishwashing detergents and rinse aids and a process for using them.

BACKGROUND OF THE INVENTION

To wash articles in a commercially available dish washing machine entails using three product types. Salt is added to the salt compartment to soften the water, a dish washing formulation is used to clean the articles and a rinse aid is used to ensure that the articles are rinsed with no streaks or smears.

The salt in the machine does not have to be replaced every wash, however it is inconvenient for consumers replace the salt.

The present invention relates to a process of washing dishes that obviates/lessens the need for salt in a machine dish washing formulation.

DESCRIPTION OF THE INVENTION

Accordingly, the present invention provides a process for washing articles in a mechanical washing machine comprising the steps of:

i) treating the articles with a wash liquor comprising a dishwashing composition and; said composition when undiluted circulated comprising greater than 20 wt.% of a bicarbonate salt; followed by ii) treating the articles with a rinsing solution comprising a rinse aid the rinse aid when undiluted comprising at least 20wt% of a water-soluble acid builder or salt thereof; wherein minimal rejuvenation of ion exchange material within the machine is needed.

The invention also discloses use of citric acid in a rinse aid composition for use in an automatic dishwashing machine so no salt is required for the rejuvenation of ion exchange material within the machine, use of bicarbonate salt in a dishwashing composition for use in an automatic dishwashing machine so no salt is required for the rejuvenation of ion exchange material within the machine and use of a chelating agent in a dish washing composition for use in an automatic dish washing machine so no salt is required for the rejuvenation of ion.

The invention further relates to a kit of parts for use in an automatic dishwashing machine comprising:

(i) a first container of rinse aid composition;

(ii) a second container of dishwashing composition and;

(iii) instructions that no salt is to be added to the machine.

DETAILED DESCRIPTION OF THE INVENTION

Dish Washing Composition

European dish washers have within them ion exchanger materials which soften the water thus aiding the cleaning of utensils and lessening deposition of insoluble salts. The ion exchange material is regenerated by the use of salt(sodium chloride), put into the machine by the consumer. Most machines have a dial which the consumer sets to a predetermined level depending on the hardness of the water supplied to the machine. Depending on the machine type the machine softens water in two ways:

On a hard water setting it either regenerates the ion exchange material frequently (e.g. every 2 washes) or it adds a high quantity of saturated sodium chloride solution to the ion exchange material (e.g. 75 ml). Correspondingly on a low water setting it either regenerates the ion-exchanger infrequently (every 5 washes) or it adds lower quantities of saturated sodium chloride solution to the ion exchange material each wash (e.g. 30 ml).

The present invention has found that the ion exchange material does not need to be as frequently rejuvenated if formulations according to the invention are used. Preferably the ion exchange material does not need to be rejuvenated; that is no salt needs to be added to the machine.

Thus a machine that frequently doses salt every 5 washes will when used with the formulation of the invention only need to dose e.g. every 2 washes, thus the dial can be set accordingly. Alternatively a machine that doses salt every wash at a dose of 25 g will only need to dose at less than 10 g At very high water harness only 40 washes from a 1kg pack of salt can be achieved, but using formulations according to the invention greater than 100 washes can be achieved.

Thus, in the present invention minimal rejuvenation of ion exchange material means that the average level of salt that is needed per wash can be represented by the following formula:

degree of hardness of water—30×25/40 g

When the degree of water hardness is 30 or less, no salt is added.

Builder Material

The detergency builder system is preferably water-soluble and more preferably comprises a bicarbonate salt, preferably sodium or potassium bicarbonate most especially sodium bicarbonate. Bicarbonate salts are particularly preferred as builders as they also have a buffering capacity. It is preferable if the bicarbonate is present at a level greater than 20 wt% of the total composition, more particularly at least 24-wt% of the total composition.

It is preferable if the builder further comprises a carboxylate or polycarboxylate builder containing from one to four carboxy groups, particularly selected from monomeric polycarboxylates or their acid forms, homo or copolymeric polycarboxylic acids or there salts in which the polycarboxylate comprises at least two carboxylic radicals selected from each other by not more than two carbon atoms. Preferred carboxylates include the polycarboxylate materials described in U.S. Pat. No. 2,264,103, including the water-soluble alkali metal salts of mellitic acid and citric acid, dipicolinic acid, oxydisuccinic acid and alkenyl succinates. The water-soluble salts of polycarboxylate polymers and copolymers, such as are described in U.S. Pat. No. 3,308,067 are also be suitable for use with the invention.

Of the builder materials listed in the above paragraph, the preferred polycarboxylates are hydroxycarboxylates containing up to three carboxy groups per molecule, especially citric acid or its salt, particularly sodium citrate. It is preferable if the carboxylate builder is present at a level of at least 20 wt% of the total formulation, more preferably at a level greater than 30 wt%.

It is preferred if the weight ratio of polycarboxylate builder to bicarbonate builder is at least 1:1, preferably greater than 3:2

Further soluble detergency builder salts which can be used with the present invention are poly-valent inorganic and poly-valent organic builders, or mixtures thereof. Non-limiting examples of suitable water-soluble, inorganic alkaline detergency builder salts include the alkali metal carbonates, borates, phosphates, polyphosphates, tripolyphosphates, phosphono carboxylates. Specific examples of such salts include the sodium and potassium tetraborates, carbonates, tripolyphosphates, orthophosphates and hexametaphosphates. However it is preferable if the detergent formulation is free or only has low levels (5% or less) of builder salts which precipitate during the wash in the presence of calcium, an example of such a salt is sodium tripolyphosphate.

In preferred builder systems the weight ratio of alkali metal bicarbonate to alkali metal carbonate is greater than 1:1, preferably greater than 2:1 in particularly preferred systems the builder does not comprises a alkali metal carbonate.

Other suitable detergency builders organic alkaline compounds such as water-soluble amino polyacetates, e.g. sodium and potassium ethylenediamine tetraacetates, nitrilotriacetates and N-(2-hydroxyethyl)nitrilodiacetates; water-soluble salts of phytic acid, e.g. sodium and potassium phytates; water-soluble polyphosphonates, including sodium, potassium and lithium salts of ethane-1-hydroxy-1, 1-diphosphonic acid; sodium, potassium and lithium salts of methylenediphosphonic acid and the like.

It is to be understood that, while the alkali metal salts of the foregoing inorganic and organic poly-valent anionic builder salts are preferred for use herein from an economic standpoint, the ammonium, alkanolammonium, e.g. triethanol-ammonium, diethanolammonium, and the like, water-soluble salts of any of the foregoing builder anions are useful herein.

Mixtures of organic and/or inorganic builder salts can be used herein.

While any of the poly-valent builder materials are useful herein, the compositions of the invention are preferably free of phosphate builders for environmental and ecological reasons.

Preferred builders for use in the invention are sodium citrate and sodium bicarbonate and mixtures thereof. Alternatively the potassium salts of these acids may be used.

Preferably, the total amount of builder in the composition is from about 30 to 80% by weight, more preferably from 40 to about 70% by weight, most preferably from 50 to 70%.

Silica Material

Suitable forms of silica include amorphous silica, such as precipitated silica, pyrogenic silica and silica gels, such as hydrogels, xerogels and aerogels, or the pure crystal forms quartz, tridymite or crystobalite, but the amorphous forms of silica are preferred. Suitable silicas may readily be obtained commercially. They are sold, for example under the Registered Trade Name Gasil 200 (ex Crosfield, UK).

Preferably, the silica is in the product in such a form that it can dissolve when added to the wash liquor. Therefore, addition of silica by way of addition anti-foam particles of silica and silicone oil is not preferred.

The particle size of the silica material of the present invention may be of importance, especially as it is believed that any silica material that remains undissolved during the washing process, may deposit on the glass at a later stage. Therefore, it is preferred that silica material are used that have a particle size (as determined with a Malvern Laser, i.e. "aggregated"particles size) of at most 40 $\mu$m, more preferably at most 30 $\mu$m, most preferably at most 20 $\mu$m provides better results in the wash. In view of incorporation in a cleaning composition, it is preferred that the particle size of the silica material is at least 1 $\mu$m, more preferably at least 2 $\mu$m, most preferably at least 5 $\mu$m.

Preferably the primarily particle size of the silica is in general less than about 30 nm, in particular less than about 25 nm. Preferably, elementary particles size are less than 20 nm or even 10 nm. There is no critical lower limit of the elementary particle size; the lower limit is governed by other factors such as the manner of manufacture, etc. In general commercial available silicas have elementary particle sizes of 1 nm or more.

Preferably, the silica material is present in the wash liquor at a level of at least $2.5\times10^{-4}$%, more preferably at least $12.5\times10^{-4}$%, most preferably at least $2.5\times10^{-3}$% by weight of the wash liquor and preferably at most $1\times10^{-1}$, more preferably at most $8\times10^{-2}$%, most preferably at most $5\times10^{-2}$% by weight of the wash liquor.

Preferably, the level of dissolved silica material in the wash liquor is at least 80 ppm, more preferably at least 100 ppm, most preferably at least 120-ppm and preferably at most 1,000 ppm. It is noted that for the silica material to be effective, the lower level of dissolved silica material depends on the pH value, i.e. thus at pH 6.5, the level is preferably at least 100 ppm; at pH 7.0 preferably at least 110 ppm; at pH 7.5 preferably at least 120 ppm; at pH 9.5 preferably at least 200 ppm; at pH 10 preferably at least 300 ppm; at pH 10.5 preferably at least 400 ppm.

Preferably, the silica material is present in the cleaning composition at a level of at least 0.1%, more preferably at least 0.5%, most preferably at least 1% by weight of the cleaning composition and preferably at most 10%, more preferably at most 8%, most preferably at most 5% by weight of the cleaning composition.

Silicates

The composition optionally comprises alkali metal silicates. The alkali metal may provide pH adjusting capability and protection against corrosion of metals and against attack on dishware, including fine china and glassware benefits. When silicates are present, the $SiO_2$ level should be from 1% to 25%, preferably from 2% to 20%, more preferably from 3% to 10%, based on the weight of the ADD. The ratio of $SiO_2$ to the alkali metal oxide ($M_2O$, where M=alkali metal) is typically from 1 to 3.5, preferably from 1.6 to 3, more preferably from 2 to 2.8. Preferably, the alkali metal silicate is hydrous, having from 15% to 25% water, more preferably, from 17% to 20%.

The highly alkali metasilicates can in general be employed, although the less alkaline hydrous alkali metal silicates having a $SiO_2$:$M_2O$ ratio of from 2.0 to 2.4 are, as noted, greatly preferred. Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles having a mean particle size between 300 and 900 microns and less than 40% smaller than 150 microns and less than 5% larger than 1700 microns. Particularly preferred is a silicate particle with a mean particle size between 400 and 700 microns with less than 20% smaller than 150 microns and less than 1% larger then 1700 microns. Compositions of the present invention having a pH of 9 or less preferably will be substantially free of alkali metal silicate.

Enzymes

Enzymes may be present in the compositions of the invention.

Examples of enzymes suitable for use in the cleaning compositions of this invention include lipases, peptidases, amylases (amylolytic enzymes) and others which degrade, alter or facilitate the degradation or alteration of biochemical soils and stains encountered in cleansing situations so as to remove more easily the soil or stain from the object being washed to make the soil or stain more removable in a subsequent cleansing step.

Well-known and preferred examples of these enzymes are lipases, amylases and proteases. The enzymes most commonly used in machine dishwashing compositions are amylolytic enzymes. Preferably, the composition of the invention also contains a proteolytic enzyme. Enzymes may be present in a weight percentage amount of from 0.2 to 5% by weight. For amylolytic enzymes, the final composition will have amylolytic activity of from $10^2$ to $10^6$ Maltose units/kg. For proteolytic enzymes the final composition will have proteolytic enzyme activity of from $10^6$ to $10^9$ Glycine Units/kg.

Bleach Material

Bleach material may optionally and preferably be incorporated in composition for use in processes according to the present invention. These materials may be incorporated in solid form or in the form of encapsulates and less preferably in dissolved form.

The bleach material may be a chlorine- or bromine-releasing agent or a peroxygen compound. Peroxygen based bleach materials are however preferred.

Organic peroxy acids or the precursors therefor are typically utilized as the bleach material. The peroxyacids usable in the present invention are solid and, preferably, substantially water-insoluble compounds. By "substantially water-insoluble" is meant herein a water-solubility of less than about 1% by weight at ambient temperature. In general, peroxyacids containing at least about 7 carbon atoms are sufficiently insoluble in water for use herein.

Inorganic peroxygen-generating compounds are also typically used as the bleaching material of the present invention. Examples of these materials are salts of monopersulphate, perborate monohydrate, perborate tetrahydrate, and percarbonate.

Monoperoxy acids useful herein include alkyl peroxy acids and aryl peroxyacids such as peroxybenzoic acid and ring-substituted peroxybenzoic acids (e.g. peroxy-alpha-naphthoic acid); aliphatic and substituted aliphatic monoperoxy acids (e.g. peroxylauric acid and peroxystearic acid); and phthaloyl amido peroxy caproic acid (PAP).

Typical diperoxy acids useful herein include alkyl diperoxy acids and aryldiperoxy acids, such as 1,12-di-peroxydodecanedioic acid (DPDA); 1,9-diperoxyazelaic acid, diperoxybrassylic acid, diperoxysebacic acid and diperoxyisophthalic acid; and 2-decyldiperoxybutane-1,4-dioic acid.

Peroxyacid bleach precursors are well known in the art. As non-limiting examples can be named N,N,N',N'-tetraacetyl ethylene diamine (TAED), sodium nonanoyloxybenzene sulphonate (SNOBS), sodium benzoyloxybenzene sulphonate (SBOBS) and the cationic peroxyacid precursor (SPCC) as described in U.S. Pat. No. 4,7S1,015.

If desirably a bleach catalyst, such as the manganese complex, e.g. Mn-Me TACN, as described in EP-A-0458397, or the sulphonimines of U.S. Pat. No. 5,041,232 and U.S. Pat. No. 5,047,163, is to be incorporated, this may be presented in the form of a second encapsulate separately from the bleach capsule or granule. Cobalt catalysts can also be used.

Among suitable reactive chlorine- or bromine-oxidizing materials are heterocyclic N-bromo and N-chloro imides such as trichloroisocyanuric, tribromoisocyanuric, dibromoisocyanuric and dichloroisocyanuric acids, and salts thereof with water-solubilizing cations such as potassium and sodium. Hydantoin compounds such as 1,3-dichloro-5,5-dimethyl-hydantoin are also quite suitable.

Particulate, water-soluble anhydrous inorganic salts are likewise suitable for use herein such as lithium, sodium or calcium hypochlorite and hypobromite. Chlorinated trisodium phosphate and chloroisocyanurates are also suitable bleaching materials.

Encapsulation techniques are known for both peroxygen and chlorine bleaches, e.g. as described in U.S. Pat. No. 4,126,573, U.S. Pat. No. 4,327,151, U.S. Pat. No. 3,983,254, U.S. Pat. No. 4,279,764, U.S. Pat. No. 3,036,013 and EP-A-0,436,971 and EP-A-0,510,761. However, encapsulation techniques are particularly useful when using halogen based bleaching systems.

Chlorine bleaches, the compositions of the invention may comprise from about 0.5% to about 3% avCl (available Chlorine). For peroxygen bleaching agents a suitable range are also from 0.5% to 3% avO (available Oxygen). Preferably, the amount of bleach material in the wash liquor is at least $12.5\times10^{-4}$% and at most 0.03% avO by weight of the liquor.

Surfactant Material

A surfactant system comprising a surfactant selected from nonionic, anionic, cationic, ampholytic and zwitterionic surfactants and mixtures thereof is preferably present in the composition.

Typically the surfactant is a low to non foaming nonionic surfactant, which includes any alkoxylated nonionic surface-active agent wherein the alkoxy moiety is selected from the group consisting of ethylene oxide, propylene oxide and mixtures thereof, is preferably used to improve the detergency without excessive foaming. However, an excessive proportion of nonionic surfactant should be avoided. Normally, an amount of 15% by weight or lower, preferably 10% by weight or lower, more preferably 7% by weight or lower, most preferably 5% by weight or lower and preferably 0.1% by weight or higher, more preferably 0.5% by weight or higher is quite sufficient, although higher level may be used.

Examples of suitable nonionic surfactants for use in the invention are the low- to non-foaming ethoxylated straight-chain alcohols of the Plurafac® RA series, supplied by the Eurane Company; of the Lutensol® LF series, supplied by the BasF Company and of the Triton® DF series, supplied by the Rohm & Haas Company.

Other surfactants such as anionic surfactant may be used but may require the additional presence of an antifoam to surpress foaming. If an anionic surfactant is used it is advantageously present at levels of 2 wt% or below.

Water Soluble Polymeric Polycarboxylic Compounds

A water-soluble polymeric polycarboxylic compound is advantageously present in the dish wash composition. Preferably these compounds are homo- or co-polymers of polycarboxylic compounds, especially co-polymeric compounds in which the acid monomer comprises two or more carboxyl groups separated by not more than two carbon atoms. Salts of these materials can also be used.

Particularly preferred polymeric polycarboxylates are co-polymers derived from monomers of acrylic acid and maleic acid. The average molecular weight of these polymers in the acid form preferably ranges from 4,000 to 70,000.

Another type of polymeric polycarboxylic compounds suitable for use in the composition of the invention are homo-polymeric polycarboxylic acid compounds with acrylic acid as the monomeric unit. The average weight of such homo-polymers in the acid form preferably ranges from 1,000 to 100,000 particularly from 3,000 to 10,000. Such polymers are present as anti-scalants.

Acrylic sulphonated polymers as described in EP 851 022 (Unilever) are also suitable.

Preferably, this polymeric material is present at a level of at least 0.1%, more preferably at levels from 1 wt% to 7 wt% of the total composition.

Chelating Agent

A chelating agent may be present in the composition. If present it is preferable if the level of chelating agent is from 0.5 to 3 wt% of the total composition.

Preferred chelating agents include organic phosphonates, amino carboxylates, polyfunctionally-substituted compounds, and mixtures thereof.

Particularly preferred chelating agents are organic phosphonates such as α-hydroxy-2 phenyl ethyl diphosphonate, ethylene diphosphonate, hydroxy 1,1-hexylidene, vinylidene 1,1 diphosphonate, 1,2 dihydroxyethane 1,1 diphosphonate and hydroxy-ethylene 1,1 diphosphonate. Most preferred is hydroxy-ethylene 1,1 diphosphonate.

These chelating agents are present to mitigate the scaling of glasses.

Anti-tarnishing Agents

Anti-tarnishing agents such as benzotriazole and those described in EP 723 577 (Unilever) may also be included.

Optional Ingredients

Optional ingredients are, for example, buffering agents, reducing agents, e.g., borates, alkali metal hydroxide and the well-known enzyme stabilisers such as the polyalcohols, e.g. glycerol and borax; anti-scaling agents; crystal-growth inhibitors, threshold agents; thickening agents; perfumes and dyestuffs and the like.

Reducing agents may e.g. be used to prevent the appearance of an enzyme-deactivating concentration of oxidant bleach compound. Suitable agents include reducing sulphuroxy acids and salts thereof. Most preferred for reasons of availability, low cost, and high performance are the alkali metal and ammonium salts of sulphuroxy acids including ammonium sulphite ($(NH_4)_2SO_3$), sodium sulphite ($Na_2SO_3$), sodium bisulphite ($NaHSO_3$), sodium metabisulphite ($Na_2S_2O_3$), potassium metabisulphite ($K_2S_2O_5$), lithium hydrosulphite ($Li_2S_2O_4$)etc., sodium sulphite being particularly preferred. Another useful reducing agent, though not particularly preferred for reasons of cost, is ascorbic acid. The amount of reducing agents to be used may vary from case to case depending on the type of bleach and the form it is in, but normally a range of about 0.01% to about 1.0% by weight, preferably from about 0.02% to about 0.5% by weight, will be sufficient.

pH of Wash Liquor

The invention relates to washing processes in mechanical dish washing machines wherein the wash liquor has a low pH. By "low pH" is meant here that the pH of the wash liquor is preferably higher than about 6.5, more preferably 7.5 or higher, most preferably 8.5 or higher. Preferably the pH is lower than about 10.5, more preferably lower than about 10, more preferably lower than about 9.5. The most advantageous pH range is from 8.5 to 10.

Temperature of Washing Process

The present invention preferably relates to processes of mechanically washing soiled articles with a wash liquor at a temperature of at least 40° C., more preferably at least 50° C., most preferably at least 55° C.

Rinse Aid

The rinse aid for use in the invention comprises a water soluble acid builder or salt, preferably organic acids including, for example, carboxylic acids, such as citric and succinic acids, polycarboxylic acids, such as polyacrylic acid, and also acetic acid, boric acid, malonic acid, adipic acid, fumaric acid, lactic acid, glycolic acid, tartaric acid, tartronic acid, maloic acid, their derivatives and any mixtures of the foregoing.

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 2.5 and 7.5.

The carboxylate or polycarboxylate builder can be monomeric or oligomeric in type although monomeric polycarboxylates are generally preferred for reasons of cost and performance. Monomeric and oligomeric builders can be selected from acyclic, alicyclic, heterocyclic and aromatic carboxylates.

Suitable carboxylates containing one carboxy group include the water-soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates, lactoxysuccinates, and aminosuccinates, and the oxypolycarboxylate materials such as 2-oxa-1,1,3-propane tricarboxylates. The carboxylate or polycarboxylate builder compounds described above can also have a dual function as pH controlling agents. Polycarboxylates containing four carboxy groups include oxydisuccinates, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives, and the sulfonated pyrolysed citrates.

Alicyclic and heterocyclic polycarboxylates include cyclopentane-cis,cis,cis-tetracarboxylates, cyclopentadienide pentacarboxylates, 2,3,4,5-tetrahydroturan-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecules, more particularly citrates or citric acid.

As an alternative to the above phosphonates may be used.

The parent acids of the monomeric or oligomeric polycarboxylate chelating agents or mixtures thereof with their salts, e.g. citric acid or citrate/citric acid mixtures are also contemplated as components of builder systems of rinse compositions in accordance with the present invention.

A surfactant system comprising a surfactant selected from nonionic, anionic, cationic, ampholytic and zwitterionic surfactants and mixtures thereof is preferably present in the composition.

The surfactant system most preferably comprises low foaming nonionic surfactant, selected for its wetting ability, preferably selected from ethoxylated and/or propoxylated nonionic surfactants, more preferably selected from nonionic ethoxylated/propoxylated fatty alcohol surfactants.

The surfactant system is typically present at a level of from 1% to 40% by weight, more preferably 1.5% to 30% by weight, most preferably from 5% to 20% by weight of the compositions. If an anionic surfactant is used it is advantageously present at levels of 1 wt% or below.

The compositions of the invention may contain organic solvents, particularly when formulated as liquids or gels. The compositions in accord with the invention preferably contain a solvent system present at levels of from 1% to 30% by weight, preferably from 3% to 25% by weight, more preferably form 5% to 20% by weight of the composition. The solvent system may be a mono or mixed solvent system. Preferably, at least the major component of the solvent system is of low volatility.

Suitable organic solvent for use herein has the general formula $RO(CH_2C(Me)\ HO)_nH$, wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1 -n-butoxypropane-2-ol (n=1): and 1(2-n-butoxy-1 -methylethoxy)propane-2-ol (n=2), and mixtures thereof.

Other solvents useful herein include the water-soluble CARBITOL[7] solvents or water-soluble CELLOSOLVE[7] solvents. Water-soluble CARBITOL[7] solvents are compounds of the 2-(2 alkoxyethoxy) ethanol class wherein the alkoxy group is derived from ethyl, propyl or butyl; a preferred water-soluble carbitol is 2(2-butoxyethoxy) ethanol also known as butyl carbitol. Water-soluble CELLOSOLVE[7] solvents are com-pounds of the 2-alkoxyethoxy ethanol class, with 2-butoxyethoxyethanol being preferred.

Other suitable solvents are benzyl alcohol, and diols such as 2-ethyl-1,3-hexanediol and 2,2,4-trimethyl-1,3-pentanediol.

Hydrotropes may be present and are typically present at levels of from 0.5% to 20%, preferably from 1% to 10%, by weight.

Useful hydrotropes include sodium, potassium, and ammonium xylene sulfonates, sodium, potassium, and ammonium toluene sulfonate, sodium potassium and ammonium cumene sulfonate, and mixtures thereof.

In a highly preferred aspect of the invention, the rinse aid compositions have a pH as a 1% solution in distilled water at 20° C. of less than 7, preferably from 0.5 to 6.5, most preferably from 0.5 to 1.0.

Product Form

The dish washing composition for use in the invention may be in any product form, however it is preferred if it granular. Granular in the context of the present invention includes both powdered material and tablets.

The rinse aid is preferably a liquid.

Dishwash compositions according to the present invention may be dosed in the wash liquor at levels of from 10 g/l to 2.5 g/l.

Rinse aid composition according to the present invention may be dosed in the final rinse liquor at levels 1 g/l or less.

The invention will now be illustrated by the following non-limiting Examples.

All percentages are on a weight basis.

EXAMPLE I

TABLE 1

| | WT/% | |
|---|---|---|
| | DW 1 | DW 2 |
| Gasil 200 TP[3] | 0 | 3.0 |
| Na-citrate 2aq | 39.3 | 40.0 |
| Na-bicarbonate | 0 | 25.6 |
| Na-carbonate | 5.5 | |
| Na-perborate | 18.0 | 16.0 |
| Enzyme | 4.0 | 3.5 |
| Sokalan PC 525[1] | 6.0 | 6.0 |
| EHDP | 1.0 | 1.5 |
| Bleach catalyst | 2.8 | 2.8 |
| Perfume | 0.2 | 0.2 |
| Nonionic surfactant[2] | 1.5 | 1.4 |
| Na disilicate | 21.7 | 0 |

[1]maleic and acrylic acid copolymer MWT 50,000, acrylic acid polymer mwt 4,000.
[2]Nonionic surfactant, ex BASF (LF 403)
[3]Silica material with an average particle size d50 (by Malvern Laser) of 7–11 mm, ex Crosfield The compositions were tested in a robotised Miele G5953C (total water hardness 28° F., including temporary hardness of 18° F.). The ion exchanger material was removed the machine, so the water was not softened.

The compositions were dosed at a level of 20 g/wash; the ain wash time was 20 minutes; the drying time with open door was 10–20 minutes; the washing temperature was up to 65° C.;

30 washes were carried out by loading the machine with on-glaze decorated porcelain, glass, plates plus cutlery, stainless steel articles and plastics, Rinse aid was added to the rinse via the rinse and dispenser. The rinse aid had the following formulations.

TABLE 2

| | wt % | |
|---|---|---|
| | RA 3 | RA 4 |
| Nonionic LF400S | 14.5 | 14.5 |
| Sodium Xylene Sulphonate | 5.0 | 5.0 |
| Citric Acid | 9.5 | 40 |
| Water | to 100% | |

ex BASF

Overall Appearance

Overall appearance was measured by placing the tested articles on a black cloth under a reflected artificial daylight source (Kelvin temperature 2300° K.); placed 2 meters above the articles. A subjective scoring system on a 1–9 scale was used 1 as new→9 extremely poor.

The overall appearance was a combination of white filming due to calcium salt deposits, spots, streaks and glass corrosion.

The results are given in table 3.

TABLE 3

| | Score | | |
|---|---|---|---|
| | Glass | Plastic | Metal |
| DW1 and RA4 | 9.0 | 6.6 | 8.5 |
| DW2 and RA3 | 5.5 | 5.4 | 7.3 |
| DW2 and RA4 | 4.0 | 4.9 | 4.2 |

EXAMPLE 2

TABLE 4

| | WT/% | |
|---|---|---|
| | DW 5 | DW 6 |
| Na disilicate | 3.0 | 10.2 |
| Na-citrate 2aq | 30.0 | 18.6 |
| Na-sulphate | 25.1 | 35.46 |
| Na-carbonate | | 20.0 |
| Na-bicarbonate | 25.7 | |
| Na-perborate | 8.0 | 7.0 |
| Enzyme | 1.7 | 2.0 |
| Sokalan PC 525[1] | 3.0 | 2.8 |
| Bleach catalyst | 2.8 | 2.4 |
| minors | to 100 | to 100 |

[1]maleic and acrylic acid copolymer MWT 50,000, acrylic acid polymer mwt 4,000.

1) maleic and acrylic acid copolymer MWT 50,000, acrylic acid polymer mwt 4,000.

The compositions were tested in a Whirlpool Machine Dishwasher ADP 9726; (total water hardness 27° F., including temporary hardness of 18° F.).

The compositions were dosed at a level of 40 g/wash; 180 washes including pre-rinse washes were carried out by loading the machine with on-glaze decorated porcelain, glass, plates plus cutlery, stainless steel articles and plastics. No salt was added to the machine during the experiment.

Rinse aid was added to the rinse via the rinse and dispenser. The rinse aid had the following formulations.

TABLE 5

| | wt % | |
|---|---|---|
| | RA 7 | RA 8 |
| Nonionic LF400S | 14.5 | 14.5 |
| Sodium Xylene Sulphonate | 5.0 | 5.0 |
| Citric Acid | 9.5 | 36.5 |
| Water | to 100% | |

ex BASF

Overall appearance

Overall appearance was measured as stated in Example 1.

1as new→9 extremely poor.

The results are given in table 6.

TABLE 6

| | Score | | |
|---|---|---|---|
| | Glass | Plastic | Metal |
| DW5 and RA8 | 4.0 | 4.2 | 4.3 |
| DW6 and RA7 | 8.0 | 7.0 | 7.6 |

What is claimed is:

1. A process for washing articles in a mechanical washing machine comprising the steps of:

i) treating the articles with a wash liquor comprising a dishwashing composition; said composition when undiluted comprising greater than 20 wt. % of a bicarbonate salt followed by ii) treating the articles with a rinsing solution comprising a rinse aid the rinse aid when undiluted comprising at least 20wt% of a water-soluble acid builder or salt thereof; wherein minimal rejuvenation of ion exchange material within the machine is needed.

2. A process according to claim 1 wherein no rejuvenation of the ion exchange material is needed.

3. A process according to claim 1 in which the water-soluble acid builder is citric acid or citrate.

4. A process according to claim 1 in which the rinse aid comprises 30 wt% or greater of water soluble acid builder or salt thereof.

5. A process according to claim 1 in which the dish washing composition comprises a silica or silicate material.

6. A process according to claim 1 in which the dishwashing composition comprises a polymer or copolymer of acrylic acid.

7. A process according to claim 1 in which the dishwashing composition has a pH in a 1% aqueous solution, at a temperature of 25° C., from 8.5 to 10.

8. A process according to claim 1 in which the dishwashing composition is granular.

9. A process according to claim 1 wherein the temperature of the wash liquor is at least 40° C.

* * * * *